US008801874B2

(12) United States Patent
Ishikawa et al.

(10) Patent No.: US 8,801,874 B2
(45) Date of Patent: Aug. 12, 2014

(54) STEEL PLATE AND STEEL PIPE FOR LINE PIPES

(75) Inventors: Nobuyuki Ishikawa, Kawasaki (JP); Makoto Suzuki, Kawasaki (JP); Tomohiro Matsushima, Fukuyama (JP); Akiyoshi Tsuji, Kawasaki (JP); Shinichi Kakihara, Fukuyama (JP); Nobuo Shikanai, Tokyo (JP); Yutaka Awajiya, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 12/741,271

(22) PCT Filed: Nov. 7, 2008

(86) PCT No.: PCT/JP2008/070726

§ 371 (c)(1),
(2), (4) Date: Sep. 13, 2010

(87) PCT Pub. No.: WO2009/061006

PCT Pub. Date: May 14, 2009

(65) Prior Publication Data

US 2010/0326559 A1 Dec. 30, 2010

(30) Foreign Application Priority Data

Nov. 7, 2007 (JP) ..... 2007-290220

(51) Int. Cl.

| | |
|---|---|
| ***C22C 38/00*** | (2006.01) |
| ***C22C 38/18*** | (2006.01) |
| ***C22C 38/14*** | (2006.01) |
| ***C22C 38/12*** | (2006.01) |
| ***F16L 9/00*** | (2006.01) |

(52) U.S. Cl.
USPC ..... 148/333; 420/84; 420/104; 420/126; 420/127; 138/171

(58) Field of Classification Search
USPC ..... 420/84, 126, 127, 104; 148/320, 148/333–335; 138/71, 171
See application file for complete search history.

(56) References Cited

FOREIGN PATENT DOCUMENTS

| | | | |
|---|---|---|---|
| EP | 1 325 967 | A1 | 7/2003 |
| EP | 1 473 376 | A1 | 11/2004 |
| EP | 1 662 014 | A1 | 5/2006 |
| JP | 61-060866 | A | 3/1986 |
| JP | 61-165207 | A | 7/1986 |
| JP | 2-263918 | A | 10/1990 |
| JP | 5-255747 | A | 10/1993 |

(Continued)

OTHER PUBLICATIONS

Nakamichi et al., English machine translation of JP 2005-060820, Mar. 10, 2005, whole document.*

*Primary Examiner* — Roy King
*Assistant Examiner* — Caitlin Kiechle
(74) *Attorney, Agent, or Firm* — DLA Piper LLP (US)

(57) ABSTRACT

A steel plate for line pipes containing, in terms of % by weight, C: 0.02 to 0.06%, Si: 0.5% or less, Mn: 0.8 to 1.6%, P: 0.008% or less, S: 0.0008% or less, Al: 0.08% or less, Nb: 0.005 to 0.035%, Ti: 0.005 to 0.025%, and Ca: 0.0005 to 0.0035%, and optionally contains one or more of Cu: 0.5% or less, Ni: 1% or less, Cr: 0.5% or less, Mo: 0.5% or less and V: 0.1% or less, and has a CP value of 0.95 or less represented by CP=4.46C(%)+2.37Mn(%)/6+{1.18Cr(%)+1.95Mo(%)+1.74V(%)}/5+{1.74Cu(%)+1.7Ni(%)}/15+22.36P(%), and a Ceq value of 0.30 or more represented by Ceq=C(%)+Mn(%)/6+{Cr(%)+Mo(%)+V(%)}/5 +{Cu(%)+Ni(%)}/15.

7 Claims, 2 Drawing Sheets

(56) References Cited

FOREIGN PATENT DOCUMENTS

| | | | |
|---|---|---|---|
| JP | 7-173536 | A | 7/1995 |
| JP | 2002-363689 | A | 12/2002 |
| JP | 2003-013138 | A | 1/2003 |
| JP | 2005-060820 | A | 3/2005 |
| JP | 2005-264217 | A | 9/2005 |
| JP | 2006-063351 | A | 3/2006 |
| JP | 2006-274338 | A | 10/2006 |

* cited by examiner

STEEL PLATE AND STEEL PIPE FOR LINE PIPES

RELATED APPLICATIONS

This is a §371 of International Application No. PCT/JP2008/070726, with an international filing date of Nov. 7, 2008 (WO 2009/061006 A1, published May 14, 2009), which is based on Japanese Patent Application No. 2007-290220, filed Nov. 7, 2007, the subject matter of which is incorporated by reference.

TECHNICAL FIELD

This disclosure relates to a high-strength steel plate for line pipes, which is used for transportation of crude oil, natural gas or the like and which is excellent in anti hydrogen induced cracking (hereinafter referred to as HIC resistance), and to a steel pipe for line pipes produced by the use of the steel plate; and relates to a steel plate and a steel pipe for line pipes especially favorable for line pipes having a pipe thickness of at least 20 mm and required to have an excellent HIC resistance.

BACKGROUND

In general, line pipes are produced by forming a steel plate produced in a plate mill or a hot-rolling mill, by UOE forming process, press bend forming process, roll forming or the like. Line pipes for use for transportation of hydrogen sulfide-containing crude oil or natural gas (hereinafter this may be referred to as "line pipes for sour gas service") are required to satisfy so-called "sour resistance" such as resistance to hydrogen induced cracking (HIC resistance), resistance to anti-stress corrosion cracking (SCC resistance) and the like, in addition to strength, toughness and weldability. Hydrogen induced cracking (hereinafter referred to as HIC) of steel is said as follows: Hydrogen ions from corrosion reaction adhere to the surface of steel and permeate into the inside of steel as atomic hydrogens, then diffuse and accumulate around the non-metal inclusions such as MnS and the like or hard second phase in steel and then form hydrogen gas thereby cracking the steel owing to the inner pressure thereof.

Heretofore, for preventing such hydrogen induced cracking, some methods have been proposed. For example, JP-A 54-110119 proposes a technique of reducing the S content of steel and adding a suitable amount of Ca, REM (rare-earth metal) or the like to steel to thereby prevent the formation of long-extending MnS and convert the shape into a finely dispersed spherical CaS inclusion. Accordingly, the stress concentration by the sulfide inclusion is reduced and cracking is therefore prevented from initiation and propagation to thereby improve the HIC resistance of steel.

JP-A 61-60866 and JP-A 61-165207 propose a technique of reducing center segregation through reduction in elements having a high tendency toward segregation (C, Mn, P, etc.) or through soaking heat treatment in a slab heating process, and changing the microstructure of steel in to bainite phase by accelerated cooling after hot rolling. Accordingly, formation of an island martensite (M-A constituent) to be a initiation point of cracking in the center segregation area, as well as formation of a hardened structure such as martensite or the like to be a propagation path of cracking can be prevented. JP-A 5-255747 proposes a carbon equivalent formula based on a segregation coefficient, and proposes a method of preventing cracking in the center segregation area by controlling it to a predetermined level or less.

Further, as countermeasures to the cracking in the center segregation area, JP-A 2002-363689 proposes a method of defining the segregation degree of Nb and Mn in the center segregation area to be not over a predetermined level, and JP-A 2006-63351 proposes a method of defining the size of the inclusion to be the initiation point of HIC and the hardness of the center segregation area.

However, heavy wall pipes having a wall thickness of at least 20 mm are increasing for recent line pipes for sour gas service; and in such heavy wall pipes, the amount of alloying elements to be added must be increased for securing the strength thereof. In that case, even when the MnS formation is prevented or the microstructure of the center segregation area is improved according to the above-mentioned prior-art methods, the hardness of the center segregation area may increase and HIC may occur from Nb carbonitride. Cracking from Nb carbonitride has a small crack length ratio, and therefore it has heretofore not been specially taken as a problem in the conventional requirement for HIC resistance. However, recently, further higher HIC resistance is required, and it has become necessary to prevent HIC from Nb carbonitride.

The method of reducing the size of an Nb-containing carbonitride to an extremely small size of 5 μm or smaller, as in JP-A 2006-63351, may be effective for preventing the occurrence of HIC in the center segregation area. In fact, however, coarse Nb carbonitride may often form in the finally-solidified zone in ingot casting or continuous casting; and for the above-mentioned severer request for HIC resistance, the material of the center segregation zone must be extremely strictly controlled for preventing initiation of HIC and for preventing the propagation of cracking from the Nb carbonitride that may form at some frequency. As the method of controlling the material of the center segregation area, there is mentioned the carbon equivalent formula proposed by JP-A 5-255747 in which a segregation coefficient is taken into consideration. However, since the segregation coefficient is experimentally obtained through analysis with an electron probe micro analyzer, it can be obtained only as a mean value within the measurement range of the spot size of, for example, around 10 μm or so. Also, this is not a method capable of strictly estimating the concentration of the center segregation area.

Accordingly, it could be helpful to provide a steel plate for high-strength line pipes excellent in HIC resistance, in particular, a steel plate for high-strength line pipes for sour gas service that has excellent HIC resistance capable of sufficiently satisfying the severe requirement for HIC resistance necessary for line pipes for sour gas service having a pipe thickness of 20 mm or more.

It could also be helpful to provide a steel pipe for line pipes, which is formed of the high-strength steel plate for line pipes having such excellent capabilities.

SUMMARY

The steel pipes to which this disclosure is directed is a steel pipe having API grade of X65 or higher (having an yield stress of at least 65 ksi and at least 450 MPa), and is a high-strength steel pipe having a tensile strength of at least 535 MPa.

We thus provide:

1. A steel plate for line pipes containing, in terms of % by weight, C: 0.02 to 0.06%, Si: 0.5% or less, Mn: 0.8 to 1.6%, P: 0.008% or less, S: 0.0008% or less, Al: 0.08% or less, Nb: 0.005 to 0.035%, Ti: 0.005 to 0.025%, and Ca: 0.0005 to 0.0035%, with a balance of Fe and inevitable impurities, which has, as represented by the following formula, a CP value of 0.95 or less and a Ceq value of 0.30 or more:

$$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%),$$

$$Ceq=C(\%)+Mn(\%)/6+\{Cr(\%)+Mo(\%)+V(\%)\}/5+\{Cu(\%)+Ni(\%)\}/15.$$

2. The steel plate for line pipes of the above 1, which further contains, in terms of % by weight, one or more of Cu: 0.5% or less, Ni: 1% or less, Cr: 0.5% or less, Mo: 0.5% or less and V: 0.1% or less.
3. The steel plate for line pipes of the above 1 or 2, wherein the hardness of the center segregation area is HV 250 or lower, and the length of the Nb carbonitride in the center segregation area is at most 20 μm or less.
4. The steel plate for line pipes of any of the above 1 to 3, wherein the microstructure of the steel plate has a bainite phase of 75% or more as the volume fraction thereof
5. A steel pipe for line pipes, produced by shaping the steel plate of any of the above 1 to 4 into a tubular form by cold forming, followed by seam-welding the butting parts thereof.

The steel plate and the steel pipe for line pipes have excellent HIC resistance and can sufficiently satisfy the requirement of severe HIC resistance especially needed for line pipes having a pipe thickness of 20 mm or more.

DETAILED DESCRIPTION

We investigated in detail the occurrence of cracking and propagation behavior thereof in a HIC test from the viewpoint of the initiation of cracking and the microstructure of the center segregation area and, as a result, have obtained the following findings.

Figure 1:
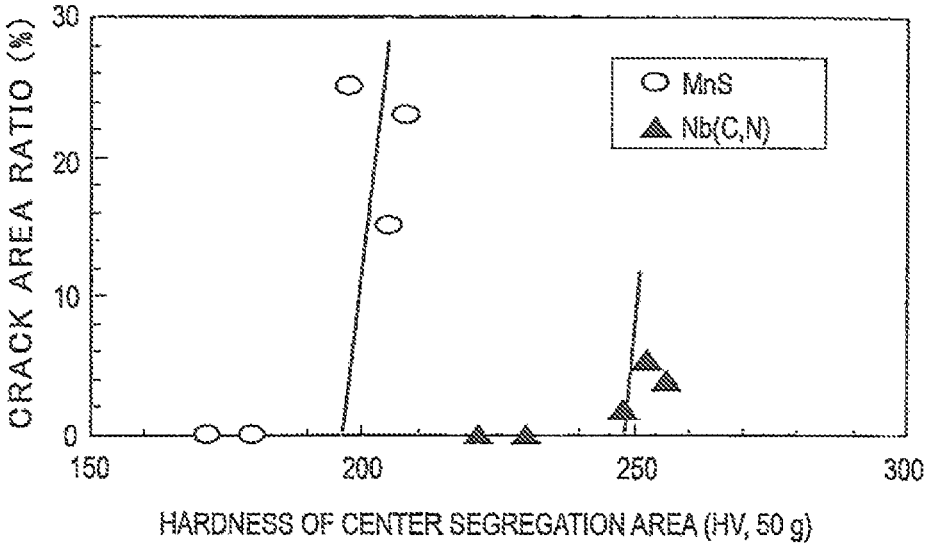
FIG. 1: A graph showing the relationship between the hardness of the center segregation area and the crack area ratio in a HIC test of a steel plate having MnS or Nb carbonitride formed in the center segregation area thereof.

First, for preventing cracking in the center segregation area, a appropriate material property of the center segregation area is necessary in accordance with the type of the inclusion that is to be the initiation point of cracking FIG. 1 shows one example of the result of a HIC test (the test method is the same as in Examples given below) of a steel plate having MnS or Nb carbonitride formed in the center segregation area thereof. According to this, it is known that, in the case where MnS exists in the center segregation area, the crack area ratio increases even the hardness is low and, therefore, controlling the growth of MnS is extremely important. However, even when the formation of MnS could be prevented, in the case where the center segregation area contains an Nb carbonitride and when the hardness thereof is over a predetermined level (in this, Vickers hardness, HV 250), then cracking occurs in the HIC test.

Figure 2:
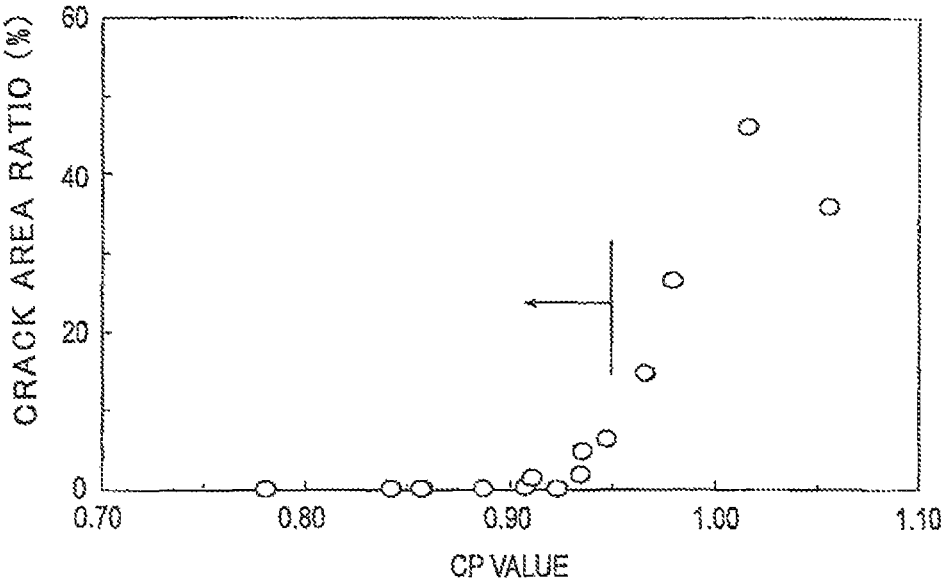
FIG. 2: A graph showing the relationship between the CP value of a steel plate and the crack area ratio thereof in a HIS test.

To solve this problem, it is necessary to strictly control the chemical compositions of the steel plate and control the hardness of the center segregation area to be not higher than a predetermined level (preferably at most HV 250). We thermodynamically analyzed the distribution behavior (or incrassate behavior) of the chemical composition in the center segregation area and have derived the segregation coefficient of the individual alloy elements. The segregation coefficient derivation is according to the following process. First, in the finally-solidified zone in casting, there are formed cavity (or voids) owing to solidification shrinkage or bulging; and the peripheral enriched molten steel flows into the cavity to form segregation spots of enriched constituent. Next, the process of solidifying the segregated spots includes constituent change in the solidification boundary based on the thermodynamic equilibrium distribution coefficient, and therefore, the concentration of the finally formed segregation area can be thermodynamically determined. Using the segregation coefficient obtained through the above-mentioned thermodynamic analysis, the CP value is obtained, corresponding to the carbon equivalent formula in the center segregation area represented by the following formula. We found that, when the CP value is controlled to be not larger than a predetermined level, then the hardness of the center segregation area can be thereby controlled to be not larger than the critical hardness to cause cracking FIG. 2 shows the relationship between the CP value represented by the following formula and the crack area ratio thereof in a HIS test (the test method is the same as in the Examples given below). According to this, when the CP value increases, then the crack area ratio rapidly increases, but cracking of HIC can be reduced by controlling the CP value to be not larger than a predetermined level.

$$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%).$$

In addition, when the size of the Nb carbonitride to be the initiation point of cracking in a HIC test is controlled to be not larger than a predetermined level, and further when the microstructure is mainly consisting fine bainite, then the cracking propagation can be prevented. Also, when combined with the above-mentioned countermeasures, more excellent HIC resistance can be attained stably.

The details of the steel plate for line pipes are described below.

First, the reason for defining the chemical compositions is described as below. % indicating the amount of the constituent is all "% by weight."

C: 0.02 to 0.06%:

C is the most effective element for increasing the strength of the steel plate to be produced through accelerated cooling. However, when the C amount is less than 0.02%, then a sufficient strength could not be secured; but on the other hand, when more than 0.06%, then the toughness and the HIC resistance may deteriorate. Accordingly, the C amount is from 0.02 to 0.06%.

Si: 0.5% or less:

Si is added for deoxidation in the steel making process. However, when the Si amount is more than 0.5%, then the toughness and the weldability may deteriorate. Accordingly, the Si amount is 0.5% or less. From the above-mentioned viewpoint, the amount of Si is more preferably 0.3% or less.

Mn: 0.8 to 1.6%:

Mn is added for enhancing the strength and the toughness of steel; but when the Mn amount is less than 0.8%, then its effect is insufficient. However, when more than 1.6&, then the weldability and the anti-HIC property may deteriorate. Accordingly, the Mn amount is within a range of from 0.8 to 1.6%. From the above-mentioned viewpoint, the Mn amount is more preferably from 0.8 to 1.3%.

P: 0.008% or less:

P is an inevitable impurity element, and increases the hardness of the center segregation area to deteriorate the HIC resistance. This tendency is remarkable when the amount is more than 0.008%. Accordingly, the P amount is 0.008% or less. From the above-mentioned viewpoint, the P amount is more preferably at most 0.006% or less.

S: 0.0008% or less:

S generally forms an MnS inclusion in steel, but Ca addition brings about inclusion morphology control to a CaS inclusion from the MnS inclusion. However, when the S amount is too much, then the amount of the CaS inclusion may increase, and in a high-strength material, it may be a starting point of cracking. This tendency is remarkable when the S amount is more than 0.008%. Accordingly, the S amount is 0.0008% or less.

Al: 0.08% or Less:

Al is added as a deoxidizing agent in steel making process. When the Al amount is more than 0.08%, then the cleanliness may lower to deteriorate the ductility. Accordingly, the Al amount is 0.08% or less. More preferably, it is or less 0.06%.

Nb: 0.005 to 0.035%:

Nb is an element to prevent the grain growth in plate rolling, therefore enhancing the toughness owing to the formation of fine grains, and it enhances the hardenability of steel to increase the strength after accelerated cooling. However, when the Nb amount is less than 0.005%, then the effect is insufficient. On the other hand, when more than 0.035%, not only the toughness of the welded heat affected zone may deteriorate but also a coarse Nb carbonitride may be formed to thereby deteriorate the HIC resistance. In particular, in the finally-solidified zone in the casting process, the alloying elements are enriched and the cooling speed is slow and, therefore, Nb carbonitride may readily form in the center segregation area. The Nb carbonitride still remains as such even in the rolled steel plate, and in an HIC test, the steel plate may crack from the Nb carbonitride. The size of the Nb carbonitride in the center segregation area is influenced by the Nb amount added and, therefore, when the uppermost limit of the Nb amount to be added is defined to be at most 0.035%, then the size may be controlled to be at most 20 μm. Accordingly, the Nb amount is from 0.005 to 0.035%. From the above-mentioned viewpoint, the Nb amount is more preferably from 0.010 to 0.030%.

Ti: 0.005 to 0.025%:

Ti forms TiN and therefore prevents the grain growth in slab heating and, in addition, it prevents the grain growth in the welded heat affected zone to thereby enhance the toughness owing to fine microstructure of base metal and the welded heat affected zone. However, when the Ti amount is less than 0.005%, then the effect is insufficient. On the other hand, when more than 0.025%, then the toughness may deteriorate. Accordingly, the Ti amount is from 0.005 to 0.025%. From the above-mentioned viewpoint, the Ti amount is more preferably from 0.005 to 0.018%.

Ca: 0.0005 to 0.0035%:

Ca is an element effective for sulfide inclusion morphology control to thereby improve the ductility and the HIC resistance. When the Ca amount is less than 0.0005%, then the effect is insufficient. However, on the other hand, even when Ca is added in an amount of more than 0.0035%, its effect may be saturated but rather the toughness may lower owing to the reduction in the cleanliness and, if so, in addition, the Ca-based oxide amount in steel may increase and the steel may crack from it with the result that the HIC resistance may also deteriorate. Accordingly, the Ca amount is from 0.0005 to 0.0035%. From the above-mentioned viewpoint, the Ca amount is preferably from 0.0010 to 0.030%.

The steel plate may further contain one or more selected from Cu, Ni, Cr, Mo and V in a range mentioned below.

Cu: 0.5% or less:

Cu is an element effective for improving the toughness and increasing the strength. To obtain the effect, the amount is preferably at least 0.02%. However, when the Cu amount is more than 0.5%, then the weldability may deteriorate. Accordingly, in the case where Cu is added, its amount is 0.5% or less. From the above-mentioned viewpoint, the Cu amount is more preferably 0.3% or less.

Ni: 1% or less:

Ni is an element effective for improving the toughness and for increasing the strength; but for obtaining the effect, the amount is preferably 0.02% or more. However, when the Ni amount is more than 1.0%, then the weldability may deteriorate. Accordingly, in the case where Ni is added, its amount is 1.0% or less. From the above-mentioned viewpoint, the Ni amount is more preferably 0.5% or less.

Cr: 0.5% or less:

Cr is an element effective for improving the hardenability to thereby increase the strength. To obtain the effect, the amount is preferably 0.02% or more. However, when the Cr amount is more than 0.5%, then the weldability may deteriorate. Accordingly, in the case where Cr is added, its amount is 0.5% or less. From the above-mentioned viewpoint, the Cr amount is more preferably 0.3% or less.

Mo: 0.5% or less:

Mo is an element effective for improving the toughness and increasing the strength; but for obtaining the effect, the amount is preferably 0.02% or more. However, when the Mo amount is more than 0.5%, then the weldability may deteriorate. Accordingly, in the case where Mo is added, its amount is 0.5% or less. From the above-mentioned viewpoint, the Mo amount is more preferably 0.3% or less.

V: 0.1% or less:

V is an element of increasing the strength not deteriorating the toughness. To obtain the effect, the amount is preferably 0.01% or more. However, when the V amount is more than 0.1%, then the weldability may greatly deteriorate. Accordingly, in the case where V is added, its amount is 0.1% or less. From the above-mentioned viewpoint, the V amount is more preferably 0.05% or less.

The balance of the steel plate is Fe and inevitable impurities.

The CP value and the Ceq value represented by the following formulae are defined.

CP value: 0.95 or less:

$$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%).$$

In this, C(%), Mn(%), Cr(%), Mo(%), V(%), Cu(%), Ni(%) and P(%) each are the content of the respective elements.

The above-mentioned formula relating to the CP value is a formula formulated for estimating the material of the center segregation area from the content of the respective alloy elements. When the CP value is higher, the concentration of the center segregation area is higher, and the hardness of the center segregation area increases. As shown in FIG. 2, when the CP value is 0.95 or less, then the hardness of the center segregation area could be sufficiently small (preferably HV 250 or lower) and cracking in a HIC test can be thereby prevented. Accordingly, the CP value is defined to be 0.95 or less. In addition, when the CP value is smaller, then the hardness of the center segregation area is lower. Therefore, in the case where a further higher HIC resistance is desired, the CP value is preferably 0.92 or less. Further, when the CP value is smaller, then the hardness of the center segregation area is lower and the HIC resistance increases and, therefore, the lowermost limit of the CP value is not defined. However, to obtain a suitable strength, the CP value is preferably 0.60 or more.

Ceq Value: 0.30 or more:

$$Ceq=C(\%)+Mn(\%)/6+\{Cr(\%)+Mo(\%)+V(\%)\}/5+\{Cu(\%)+Ni(\%)\}/15.$$

Ceq is a carbon equivalent of steel, and this is a hardenability index. When the Ceq value is higher, then the strength of steel is higher.

Our approach improves the HIC resistance of heavy-wall line pipes for sour gas service having a heavy wall thickness of 20 mm or more, and to obtain heavy wall pipes having a sufficient strength, the Ceq value must be 0.30 or more. Accordingly, the Ceq value is 0.30 or more. When the Ceq value is higher, then the strength can be higher and therefore steel pipes having a larger pipe thickness can be produced. However, when the alloy element concentration is too high, then the hardness of the center segregation area may also increase and the HIC resistance may deteriorate. Therefore, the uppermost limit of the Ceq value is preferably 0.42%.

The steel plate and the steel pipe preferably satisfy the following conditions in regard to the hardness of the center segregation area and the Nb carbonitride to be an initiation point of HIC.

Hardness of Center Segregation Area: Vickers Hardness, HV 250 or Lower:

As described in the above, the mechanism of crack growth in HIC is that hydrogen accumulates around the inclusion and the like in steel to cause cracking, and the cracking propagates around the inclusion thereby bringing about large cracks. In this, the center segregation area is a site to be most readily cracked, cracking readily propagates. Therefore, when the hardness of the center segregation area is larger, then the cracking occurs more readily. In the case where the hardness of the center segregation area is HV 250 or lower, and even when small Nb carbonitride may remain in the center segregation area, the cracking would hardly propagate and, therefore, the crack area ratio in the HIC test may be reduced. However, when the hardness of the center segregation area is higher than HV 250, the cracking may readily propagate and, in particular, the cracks generated in the Nb carbonitride readily propagate. Accordingly, the hardness of the center segregation area is preferably HV 250 or lower and, in the case where severe HIC resistance is required, the hardness of the center segregation area must be further reduced and, in such a case, the hardness of the center segregation area is preferably HV 230 or lower.

Length of Nb Carbonitride in Center Segregation Area: 20 μm or Less:

The Nb carbonitride formed in the center segregation area is a hydrogen accumulation point in the HIC test, and cracks may occur initiating from the point. When the size of the Nb carbonitride is larger, then the cracks may readily propagate and, even though the hardness of the center segregation area is not more than HV 250, the cracks may propagate. In the case where the length of the Nb carbonitride is 20 μm or less, then the cracks may be prevented from propagating when the hardness of the center segregation area is not more than HV 250. Accordingly, the length of the Nb carbonitride is 20 μm or less, preferably 10 μm or less. The length of the Nb carbonitride means the maximum length of the grain.

Our approach is favorable especially for steel plates for line pipes for sour gas service having a wall thickness of 20 mm or more. This is because, in general, when the plate thickness (pipe wall thickness) is less than 20 mm, then the amount of the alloying element added is small and, therefore, the hardness of the center segregation area could be low and, in such a case, the steel plate could readily have a good HIC resistance. In the case where steel plates are thicker, the amount of the alloying element therein increases and, therefore, it becomes difficult to reduce the hardness of the center segregation area in such thick plates. Especially for such thick steel plates having a plate thickness of more than 25 mm, our approach can more effectively exhibit the advantages thereof.

The steel pipes are all steel pipes having API grade X65 or higher (yield stress of at least 65 ksi and at least 450 MPa), and are high-strength steel pipes having a tensile strength of at least 535 MPa.

The metal structure of the steel plate (and the steel pipe) preferably has a bainite phase of 75% or more as the volume fraction thereof, more preferably 90% or more. The bainite phase is a microstructure excellent in strength and toughness, and in the case where the volume fraction thereof is 75% or more, then cracking propagation may be prevented in the steel plate, and the steel plate can have a high strength and a high HIC resistance. On the other hand, in a microstructure in which the volume fraction of a bainite phase is low, for example, in a mixed structure of a ferrite, pearlite, MA (island martensite), martensite or the like microstructure and a bainite phase, the cracking propagation in the phase interface may be promoted and the HIC resistance may be thereby deteriorated. In the case where the volume fraction of the microstructure (ferrite, pearlite, martensite or the like) except a bainite phase is less than 25%, then the deterioration of HIC resistance may be small and, therefore, the volume fraction of the bainite phase is preferably 75% or more. From the same viewpoint, the volume fraction of the bainite phase is more preferably 90% or more.

The steel plate is defined in point of the chemical composition, the hardness of the center segregation area and the size of the Nb carbonitride as above, and further its microstructure is defined to be a structure of mainly bainite and, accordingly, the steel plate can have an excellent -HIC resistance even when its plate thickness is large. Therefore, the steel plate can be produced basically according to the same production method as before. However, to obtain not only the HIC resistance, but also the optimum strength and toughness, the steel plate is preferably produced under the condition mentioned below.

Slab Heating Temperature: 1000 to 1200° C.:

In the case where the slab heating temperature in hot rolling a slab is lower than 1000° C., then a sufficient strength could not be obtained. On the other hand, when higher than 1200° C., then the toughness and the DWTT property (drop weight tear test property) may deteriorate. Accordingly, the slab heating temperature is preferably from 1000 to 1200° C.

To obtain a high base metal toughness in the hot rolling process, the hot rolling finish temperature is preferably lower, but on the contrary, the rolling efficiency may lower. Therefore, the hot rolling finish temperature may be defined to be a suitable temperature in consideration of the necessary base metal toughness and the rolling efficiency. For obtaining a high base metal toughness, the reduction ratio in the non-recrystallization temperature zone is preferably at least 60% or more.

After the hot rolling, accelerated cooling is preferably applied under the following condition.

Steel Plate Temperature at the Start of Accelerated Cooling: not Lower than (Ar3-10° C.):

The Ar3 is a ferrite transformation temperature that is given Ar3(° C.)=910−310C(%)−80Mn(%)−20Cu(%)−15Cr(%)−55Ni(%)−80Mo(%), from the steel chemical compositions.

In the case where the steel plate temperature at the start of the accelerated cooling is low, then the ferrite volume fraction before accelerated cooling is large and, in particular, in the case where the temperature is lower than Ar3 temperature by more than 10° C., then the HIC resistance may deteriorate. In addition, the microstructure of the steel plate could not secure a sufficient volume fraction of the bainite phase (preferably 75% or more). Accordingly, the steel plate temperature at the start of the accelerated cooling is preferably not lower than (Ar3-10° C.).

Cooling Speed in Accelerated Cooling: not Lower than 5° C./Sec:

The cooling speed in accelerated cooling is preferably not lower than 5° C./sec for stably obtaining the sufficient strength.

Steel Plate Temperature at the Stop of Accelerated Cooling: 250 to 600° C.:

The accelerated cooling is an important process for obtaining a high strength through bainite transformation. However, when the steel plate temperature at the time of stopping the accelerated cooling is over 600° C., then the bainite transformation may be incomplete and a sufficient strength could not be obtained. On the other hand, when the steel temperature at the time of stopping the accelerated cooling is lower than 250° C., then a hard structure such as MA (island martensite) or the like may be formed and, if so, not only the HIC resistance may readily deteriorate but also the hardness of the surface of the steel plate may be too high, and the flatness of the steel plate may be readily deteriorated and the formability thereof may deteriorate. Accordingly, the steel temperature at the stop of the accelerated cooling is from 250 to 600° C.

Regarding the steel plate temperature mentioned above, in the case where the steel plate has a temperature distribution in the plate thickness direction, then the steel plate temperature is the mean temperature in the plate thickness direction. However, in the case where the temperature distribution in the plate thickness direction is relatively small, then the temperature of the surface of the steel plate could be the steel plate temperature. Immediately after the accelerated cooling, there may be a temperature difference between the surface and the inside of the steel plate. However, the temperature difference may be soon decreased through thermal conduction, and the steel plate could have a uniform temperature distribution in the plate thickness direction. Accordingly, based on the surface temperature of the steel plate after homogenizing in thickness direction, the steel plate temperature at the stop of the accelerated cooling may be determined.

After the accelerated cooling, the steel plate may be kept cooled in air, but for the purpose of homogenizing the material property inside the steel plate, it my be re-heated in a gas combustion furnace or by induction heating.

Next, the steel pipe for line pipes is described. The steel pipe for line pipes is a steel pipe produced by forming the steel plate as described above, into a tubular form by cold forming, followed by seam-welding the butting parts thereof.

The cold forming method may be any method, in which, in general, the steel plate is shaped into a tubular form according to a UOE process or through press bending or the like. The method of seam-welding the butting parts is not specifically defined and may be any method capable of attaining sufficient joint strength and joint toughness. However, from the viewpoint of the welding quality and the production efficiency, especially preferred is submerged arc welding. After seam welding of the jointing parts, the pipe is processed for mechanical expansion for the purpose of removing the welding residual stress and improving the steel pipe roundness. In this, the mechanical expansion ratio is preferably from 0.5 to 1.5% under the condition that a predetermined steel pipe roundness can be obtained and the residual stress can be removed.

EXAMPLES

Steel slubs having the chemical compositions shown in Table 1 (Steels A to V) were produced by a continuous casting process and, using these, thick steel plates having a plate thickness of 25.4 mm and 33 mm were produced.

A heated slab was hot-rolled, and then accelerated cooled to have a predetermined strength. In this, the slab heating temperature was 1050° C., the rolling finish temperature was 840 to 800° C., and the accelerated cooling start temperature was 800 to 760° C. The accelerated cooling stop temperature was 450 to 550° C. All the obtained steel plates satisfied a strength of API X65, and the tensile strength thereof was from 570 to 630 MPa. Regarding the tensile property of the steel plates, a full thickness test specimen in the transverse direction to rolling was used in a tensile test to determine the tensile strength thereof.

From 6 to 9 HIC test pieces were taken from the steel plate at different positions thereof, and tested for the HIC resistance thereof. The HIC resistance was determined as follows: The test piece was dipped in an aqueous solution of 5% NaCl+0.5% $CH_3COOH$ saturated with hydrogen sulfide having a pH of around 3 (ordinary NACE solution) for 96 hours, and then the entire surface of the test piece was checked for cracks through ultrasonic flaw detection, and the test piece was evaluated based on the crack area ratio (CAR) thereof. One of 6 to 9 test pieces of the steel plate having the largest crack area ratio is taken as the typical crack area ratio of the steel plate, and those having a crack area ratio of at most 6% are good.

The hardness of the center segregation area was determined as follows: The cross sections cut in the plate thickness direction of plural samples taken from the steel plate were polished, then lightly etched, and the part where the segregation lines were seen was tested with a Vickers hardness meter under a load of 50 g, and the maximum value was taken as the hardness of the center segregation area.

The length of the Nb carbonitride in the center segregation area was determined as follows: The fracture surface of the part where the sample was cracked in the HIC test was observed with an electron microscope, and the maximum length of the Nb carbonitride grains in the fracture surface was measured, and this is the length of the Nb carbonitride in the center segregation area. Those hardly cracked in the HIC test were processed as follows: Plural cross sections of the HIC test pieces were polished, then lightly etched, and the part where the segregation lines were seen was analyzed for elemental mapping with an electron probe micro analyzer (EPMA) to identify the Nb carbonitride, and the maximum length of the grains was measured to be the length of the Nb carbonitride in the center segregation area. Regarding the microstructure, the samples were observed with an optical microscope at the center part of the plate thickness thereof and at the position of t/4 thereof, and the thus-taken photographic pictures were image-processed to measure the area fraction of the bainite phase. The bainite area fraction was measured in 3 to 5 views, and the data were averaged to be the volume fraction of the bainite phase.

The above-mentioned test and measurement results are shown in Table 2.

In Table 1 and Table 2, the steel plates (steels) of Nos. A to K and U and V that are examples all have a small crack area ratio in the HIC test, and have extremely good HIC resistance.

As opposed to these, the steel plates (steels) L to O that are comparative samples have a CP value of more than 0.95, or that is, the hardness of the center segregation area thereof is high, and they have a high crack area ratio in the HIC test, and have a poor HIC property. Similarly, in the steel plates (steels) P and Q, the Mn amount or the S amount is larger than our range of, and therefore MnS formed in the center segregation area of those steel plates. Accordingly, the steel plates cracked from MnS and their HIC resistance is low. Also similarly, in the steel plate (steel) R, the Nb amount is larger than our range and, therefore, coarse Nb carbonitride formed in the center segregation area of the steel plate and, accordingly, the HIC resistance thereof is low through the CP value thereof falls within our range. Similarly, no Ca was added to the steel plate (steel) S, which therefore did not undergo morphology control of sulfide inclusion by Ca and, accordingly, the HIC resistance of the steel plate is low. Similarly, in the steel plate (steel) T, the Ca amount is larger than our range and, therefore, the Ca oxide amount increased in the steel. Accordingly, the steel plate cracked from the starting point of the oxide, and the HIC resistance of the steel plate is low.

Some steel plates shown in Table 2 were formed into steel pipes. Concretely, the steel plate was cold-rolled according to a UOE process to give a tubular form, and the butting parts thereof were welded by submerged arc welding (seam welding) of each one layer of the inner and outer faces, then these were processed for mechanical expansion of 1% in terms of the outer periphery change of the steel pipe, thereby producing steel pipes having an external diameter of 711 mm.

The produced steel pipes were tested in the same HIC test as that for the steel plates mentioned above. The results are shown in Table 3. The HIC resistance was determined as follows: One test piece is cut into quarters in the length direction, and the cross section is observed, and the sample is evaluated based on the crack length ratio (CLR) (mean value of [total of crack length/width (20 mm) of test piece]).

In Table 3, Nos. 1 to 10 and 18 and 19 are our steel pipes, and the crack length ratio in the HIC test thereof is not higher than 10%, and the steel pipes have an excellent HIC resistance. On the other hand, the steel pipes of comparative examples, Nos. 11 to 17 all have a low HIC resistance.

Industrial Applicability

Thick steel plates having a plate thickness of 20 mm or more have an extremely excellent HIC resistance. They are applicable to line pipes that are required to satisfy the recent, severer HIC resistance.

Our approach is effective when applied to heavy wall pipes having a wall thickness of 20 mm or more; and steel pipes having a larger wall thickness require addition of alloy elements, and it may be difficult to reduce the hardness of the center segregation area thereof. Accordingly, our steels can exhibit its effect when applied to thick steel plates of more than 25 mm in thickness.

TABLE 1

| | Chemical Constituent (mas. %) | | | | | | | | | | | | | | | | | |
|---|---|---|---|---|---|---|---|---|---|---|---|---|---|---|---|---|---|---|
| Steel | C | Si | Mn | P | S | Cu | Ni | Cr | Mo | Nb | V | Ti | Ca | Al | 0 | Ceq | CP | Remarks |
| A | 0.049 | 0.25 | 1.54 | 0.002 | 0.0004 | 0 | 0 | 0 | 0 | 0.033 | 0 | 0.012 | 0.0018 | 0.034 | 0.0015 | 0.31 | 0.87 | Example of the Invention |
| B | 0.051 | 0.16 | 1.38 | 0.002 | 0.0004 | 0.25 | 0 | 0.05 | 0 | 0.025 | 0 | 0.012 | 0.0018 | 0.034 | 0.0015 | 0.31 | 0.86 | Example of the Invention |
| C | 0.043 | 0.25 | 1.25 | 0.006 | 0.0005 | 0 | 0.12 | 0 | 0.16 | 0.015 | 0.035 | 0.007 | 0.0024 | 0.025 | 0.0012 | 0.30 | 0.91 | Example of the Invention |
| D | 0.034 | 0.29 | 1.32 | 0.003 | 0.0005 | 0 | 0.27 | 0.24 | 0.00 | 0.029 | 0.044 | 0.010 | 0.0023 | 0.032 | 0.0018 | 0.33 | 0.84 | Example of the Invention |
| E | 0.033 | 0.28 | 1.10 | 0.002 | 0.0003 | 0 | 0.28 | 0.24 | 0.13 | 0.027 | 0.042 | 0.010 | 0.0013 | 0.028 | 0.0012 | 0.32 | 0.78 | Example of the Invention |
| F | 0.056 | 0.24 | 1.15 | 0.002 | 0.0006 | 0 | 0.20 | 0.18 | 0.15 | 0.030 | 0.043 | 0.009 | 0.0022 | 0.025 | 0.0009 | 0.34 | 0.89 | Example of the Invention |
| G | 0.038 | 0.30 | 1.12 | 0.006 | 0.0007 | 0 | 0.27 | 0.24 | 0.16 | 0.030 | 0.044 | 0.010 | 0.0024 | 0.025 | 0.0013 | 0.33 | 0.91 | Example of the Invention |
| H | 0.047 | 0.30 | 1.26 | 0.004 | 0.0005 | 0 | 0 | 0.27 | 0.16 | 0.030 | 0.002 | 0.010 | 0.0026 | 0.022 | 0.0015 | 0.34 | 0.92 | Example of the Invention |
| I | 0.044 | 0.30 | 1.13 | 0.006 | 0.0005 | 0 | 0.28 | 0.24 | 0.14 | 0.030 | 0.044 | 0.010 | 0.0024 | 0.028 | 0.0014 | 0.34 | 0.93 | Example of the Invention |
| J | 0.049 | 0.29 | 1.15 | 0.008 | 0.0006 | 0.18 | 0.09 | 0.24 | 0.00 | 0.032 | 0.024 | 0.010 | 0.0024 | 0.034 | 0.0012 | 0.31 | 0.95 | Example of the Invention |
| K | 0.043 | 0.20 | 1.22 | 0.007 | 0.0004 | 0 | 0.00 | 0.25 | 0.12 | 0.035 | 0 | 0.012 | 0.0022 | 0.032 | 0.0015 | 0.32 | 0.94 | Example of the Invention |
| L | 0.064 | 0.21 | 1.22 | 0.004 | 0.0004 | 0.23 | 0.22 | 0.00 | 0.13 | 0.025 | 0.024 | 0.012 | 0.0027 | 0.030 | 0.0020 | 0.33 | 0.97 | Comparative Example |
| M | 0.046 | 0.22 | 1.36 | 0.006 | 0.0006 | 0 | 0.12 | 0.15 | 0.14 | 0.000 | 0 | 0.009 | 0.0022 | 0.028 | 0.0015 | 0.34 | 0.98 | Comparative Example |
| N | 0.041 | 0.30 | 1.30 | 0.011 | 0.0006 | 0.3 | 0.18 | 0.04 | 0.08 | 0.030 | 0.054 | 0.012 | 0.0032 | 0.025 | 0.0018 | 0.32 | 1.06 | Comparative Example |
| O | 0.053 | 0.30 | 1.11 | 0.011 | 0.0007 | 0.17 | 0.09 | 0.25 | 0.00 | 0.048 | 0.024 | 0.009 | 0.0029 | 0.025 | 0.0010 | 0.31 | 1.02 | Comparative Example |
| P | 0.034 | 0.25 | 1.71 | 0.002 | 0.0006 | 0.24 | 0.12 | 0.00 | 0.00 | 0.032 | 0 | 0.012 | 0.0016 | 0.026 | 0.0014 | 0.34 | 0.91 | Comparative Example |
| Q | 0.043 | 0.15 | 1.23 | 0.004 | 0.0012 | 0 | 0.25 | 0.25 | 0.12 | 0.032 | 0.035 | 0.011 | 0.0032 | 0.030 | 0.0012 | 0.35 | 0.91 | Comparative Example |
| R | 0.048 | 0.29 | 1.14 | 0.006 | 0.0006 | 0.18 | 0.09 | 0.24 | 0.08 | 0.040 | 0.024 | 0.010 | 0.0024 | 0.031 | 0.0012 | 0.33 | 0.93 | Comparative Example |

TABLE 1-continued

| Steel | Chemical Constituent (mas. %) | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | Nb | V | Ti | Ca | Al | 0 | Ceq | CP | Remarks |
| S | 0.050 | 0.26 | 1.14 | 0.005 | 0.0005 | 0 | 0.15 | 0.22 | 0.10 | 0.028 | 0 | 0.009 | tr | 0.032 | 0.0018 | 0.31 | 0.89 | Comparative Example |
| T | 0.049 | 0.16 | 1.22 | 0.005 | 0.0004 | 0.28 | 0.19 | 0.00 | 0.10 | 0.028 | 0.042 | 0.008 | 0.0042 | 0.028 | 0.0014 | 0.31 | 0.92 | Comparative Example |
| U | 0.041 | 0.30 | 1.21 | 0.006 | 0.0005 | 0 | 0.26 | 0.24 | 0.11 | 0.028 | 0.042 | 0.009 | 0.0015 | 0.025 | 0.0012 | 0.34 | 0.94 | Example of the Invention |
| V | 0.043 | 0.30 | 1.20 | 0.003 | 0.0004 | 0 | 0.22 | 0.25 | 0.12 | 0.030 | 0.045 | 0.010 | 0.0023 | 0.031 | 0.0016 | 0.34 | 0.88 | Example of the Invention |

TABLE 2

| Steel | Plate Thickness mm | Tensile Strength MPa | Bainite Volume Fraction (%) | Length of Nb Carboniride (μm) | Hardness of the Center Segregation Area (HV 50 g) | HIC Test Result CAR (%) | Remarks |
|---|---|---|---|---|---|---|---|
| A | 25.4 | 623 | 100 | 8 | 223 | 2.5 | Example of the Invention |
| B | 25.4 | 623 | 98 | 10 | 218 | 0.0 | Example of the Invention |
| C | 25.4 | 631 | 100 | 6 | 238 | 0.2 | Example of the Invention |
| D | 33.0 | 586 | 100 | 8 | 220 | 0.0 | Example of the Invention |
| E | 33.0 | 576 | 100 | 6 | 213 | 0.0 | Example of the Invention |
| F | 33.0 | 611 | 98 | 10 | 210 | 0.0 | Example of the Invention |
| G | 33.0 | 587 | 100 | 10 | 225 | 1.3 | Example of the Invention |
| H | 33.0 | 583 | 100 | 5 | 240 | 0.0 | Example of the Invention |
| I | 33.0 | 620 | 100 | 6 | 235 | 1.8 | Example of the Invention |
| J | 33.0 | 586 | 97 | 8 | 248 | 5.2 | Example of the Invention |
| K | 33.0 | 598 | 98 | 10 | 242 | 4.6 | Example of the Invention |
| L | 33.0 | 588 | 100 | 6 | 272 | 14.6 | Comparative Example |
| M | 33.0 | 612 | 97 | 6 | 265 | 26.4 | Comparative Example |
| N | 33.0 | 596 | 96 | 8 | 295 | 35.9 | Comparative Example |
| O | 25.4 | 576 | 100 | 25 | 268 | 45.8 | Comparative Example |
| P | 33.0 | 614 | 100 | — | 232 | 12.2 | Comparative Example |
| Q | 33.0 | 620 | 98 | — | 225 | 29.3 | Comparative Example |
| R | 33.0 | 598 | 96 | 23 | 242 | 12.8 | Comparative Example |
| S | 33.0 | 578 | 96 | — | 238 | 29.5 | Comparative Example |
| T | 33.0 | 569 | 100 | — | 224 | 8.7 | Comparative Example |
| U | 33.0 | 582 | 80 | 5 | 246 | 6.0 | Example of the Invention |
| V | 27.8 | 596 | 92 | 5 | 235 | 1.8 | Example of the Invention |

TABLE 3

| No. | Steel | Plate Thickness mm | HIC Test Result CLR (%) | Remarks |
|---|---|---|---|---|
| 1 | A | 25.4 | 8.4 | Example of the Invention |
| 2 | B | 25.4 | 0.0 | Example of the Invention |
| 3 | C | 25.4 | 2.3 | Example of the Invention |
| 4 | D | 25.4 | 0.0 | Example of the Invention |
| 5 | E | 33.0 | 1.2 | Example of the Invention |
| 6 | F | 33.0 | 0.0 | Example of the Invention |
| 7 | H | 33.0 | 0.0 | Example of the Invention |
| 8 | I | 33.0 | 2.2 | Example of the Invention |
| 9 | J | 33.0 | 6.6 | Example of the Invention |
| 10 | K | 33.0 | 5.1 | Example of the Invention |
| 11 | L | 33.0 | 22.4 | Comparative Example |
| 12 | M | 33.0 | 30.2 | Comparative Example |
| 13 | N | 33.0 | 46.7 | Comparative Example |
| 14 | O | 25.4 | 45.8 | Comparative Example |
| 15 | P | 33.0 | 19.2 | Comparative Example |
| 16 | Q | 33.0 | 31.1 | Comparative Example |
| 17 | R | 33.0 | 17.5 | Comparative Example |
| 18 | U | 33.0 | 7.6 | Example of the Invention |
| 19 | V | 27.8 | 3.3 | Example of the Invention |

The invention claimed is:

1. A steel plate for line pipes containing, in terms of % by weight, C: 0.02 to 0.06%, Si: 0.5% or less, Mn: 0.8 to 1.6%, P: 0.008% or less, S: 0.0008% or less, Al: 0.08% or less, Nb: 0.005 to 0.035%, Ti: 0.005 to 0.025%, Cr:0.02% to 0.5% and Ca: 0.0005 to 0.0035%, with a balance of Fe and inevitable impurities, which has, as represented by the following formula, a CP value of 0.95 or less and a Ceq value of 0.30 or more:

$$CP=4.46C(\%)+2.37Mn(\%)/6+\{1.18Cr(\%)+1.95Mo(\%)+1.74V(\%)\}/5+\{1.74Cu(\%)+1.7Ni(\%)\}/15+22.36P(\%),$$

$$Ceq=C(\%)+Mn(\%)/6+\{Cr(\%)+Mo(\%)+V(\%)\}/5+\{Cu(\%)+Ni(\%)\}/15, \text{ and}$$

wherein hardness of a center segregation area is HV 250 or lower, and the length of Nb carbonitride in the center segregation area is 20 μm or less.

2. The steel plate of claim 1, further comprising, in terms of % by weight, one or more of Cu: 0.5% or less, Ni: 1% or less, Mo: 0.5% or less and V: 0.1% or less.

3. The steel plate of claim 1, having microstructure with a bainite phase of 75% or more as the volume fraction thereof.

4. A steel pipe for line pipes, produced by forming the steel plate of claim 1 into a tubular form by cold forming, followed by seam-welding the butting parts thereof.

5. The steel plate of claim 2, having microstructure with a bainite phase of 75% or more as the volume fraction thereof.

6. A steel pipe for line pipes, produced by forming the steel plate of claim 2 into a tubular form by cold forming, followed by seam-welding the butting parts thereof.

7. A steel pipe for line pipes, produced by forming the steel plate of claim 3 into a tubular form by cold forming, followed by seam-welding the butting parts thereof.

* * * * *